US005199758A

United States Patent [19]

Howell

[11] Patent Number: 5,199,758

[45] Date of Patent: Apr. 6, 1993

[54] CARRIER APPARATUS FOR CARRYING OBJECTS

[76] Inventor: Nila G. Howell, 16 Honey Locust, Apt. 4, St. Charles, Mo. 63303

[21] Appl. No.: 739,880

[22] Filed: Aug. 2, 1991

[51] Int. Cl.[5] ..... A45C 13/26

[52] U.S. Cl. ..... 294/171; 294/153; 383/13

[58] Field of Search ..... 294/171, 170, 137, 153; 16/114 B, 114 R; 383/13, 25

[56] References Cited

U.S. PATENT DOCUMENTS

| | | | |
|---|---|---|---|
| 476,803 | 6/1892 | Long et al. | 383/13 X |
| 709,936 | 9/1902 | Stewart | 294/171 |
| 1,349,457 | 8/1920 | Hurd | 294/170 X |
| 2,394,050 | 2/1946 | Goza | 294/171 |
| 2,519,186 | 8/1950 | Herbert et al. | 294/171 X |
| 2,528,239 | 10/1950 | McVay | 294/171 X |
| 4,678,221 | 7/1987 | Josenhans | 294/170 |

FOREIGN PATENT DOCUMENTS

| | | | |
|---|---|---|---|
| 3509679 | 9/1986 | Fed. Rep. of Germany | 294/171 |
| 38549 | 12/1923 | Norway | 294/171 |
| 2153213 | 8/1985 | United Kingdom | 294/171 |

*Primary Examiner*—Margaret A. Focarino
*Assistant Examiner*—Joseph D. Pape
*Attorney, Agent, or Firm*—Rogers, Howell & Haferkamp

[57] ABSTRACT

A carrier apparatus for carrying packages is formed in the configuration of a tubular body having opposite ends and a slot spiraling through the body between its opposite ends. The carrier apparatus is easily attached to and removed from cords secured to objects such as binding cords of packages or cord or plastic loop handles of shopping bags by inserting the cords or handles in the slot at one end of the body, and then rotating the body around its longitudinal axis causing the cords or slots to be directed along the length of the spiraling slot from one end of the apparatus to the other end of the apparatus. The carrier apparatus provides a rigid carrier or holder on the package or bag cords or handles that fits comfortably in the palm of a user's hand.

20 Claims, 1 Drawing Sheet

CARRIER APPARATUS FOR CARRYING OBJECTS

BACKGROUND OF THE INVENTION (1) Field of the Invention

The present invention relates to a carrier apparatus for carrying packages or any other object having a cord attached thereto or loop type handles provided thereon for engaging in the carrier apparatus of the invention. In particular, the present invention relates to a carrier apparatus that is easily attached to and removed from a cord attached to an object such as, but not limited to, a binding cord of a package, or cord or plastic loop handles of a shopping bag, and provides a rigid carrier or holder on the package or bag handles that fits comfortably in the palm of a user's hand.

(2) Description of the Related Art

Shopping bag and package carriers or holders have been known in the prior art for some time. Examples of prior art carriers and holders are disclosed in U.S. Pat. Nos. 480,618 of Palmer; U.S. Pat. No. 709,936 of Stewart; and U.S. Pat. No. 2,519,186 of Herbert et al. Objectives of package carriers and holders of the type disclosed in the above referred to patents are to provide a simple device that is readily applied to the binding strings or cords of a package or shopping bag, to comfortably carry the package or shopping bag to which they are attached, and to avoid being accidentally detached from the package or shopping bag when in use.

However, each of the carriers and holders described in the above-referred to patents are disadvantaged in that they must be attached to the cords of the packages or shopping bags in a set orientation of the carriers or holders relative to the packages or bags. If the carriers or holders deviate from their required orientations relative to the packages or bags to which they are attached, they could possibly become accidentally detached from the packages or bags.

What is needed is an improved shopping bag or package carrier that may be easily attached to a cord or cords secured to an object such as the cords of a package or shopping bag, and is not required to be maintained in any particular orientation relative to the object, package or bag to avoid it being accidentally detached from the object, package or bag. Such an improved carrier would eliminate the need for maintaining the carrier in a set orientation relative to the object, package or bag when in use.

SUMMARY OF THE INVENTION

The carrier apparatus of the present invention is basically comprised of a carrier body having a tubular configuration. The carrier body has a predetermined longitudinal length, a cylindrical exterior surface, and an internal bore extending longitudinally through the body between its opposite ends, the internal bore being defined by a cylindrical interior surface of the body.

A slot is formed through the side wall of the body and extends between its opposite ends. The slot is formed as a continuous spiral that spirals at least one half of a revolution around the circumference of the tubular body, and preferably spirals at least one complete revolution around the body as it extends longitudinally between the body's opposite ends. The ends of the slot open wide to facilitate the insertion of a cord secured to an object, such as a cord binding a package or cord or plastic handles of a shopping bag, into the slot at one end of the tubular body. The term "cord" is used herein to mean any type of cord, band or loop secured to an object, for example, the string or cord handles formed at the tops of some paper shopping bags and the plastic handles formed on plastic shopping bags, as well as string cords used to bind packages.

The shopping bag cords or handles are inserted into the slot at one end of the tubular body of the carrier. By then rotating the carrier around its longitudinal axis, the cords or handles are directed through the spiraling slot from one end of the tubular body to the opposite end of the tubular body. Directing the cords or handles through the slot in this manner threads the cords or handles through the internal bore of the carrier and attaches the carrier on the cords or handles.

Alternatively, the tubular body is held so that the slot appears as a diagonal extending over the top of the body between its first and second ends. The shopping bag cords or handles are then stretched out straight over the diagonal, and are then inserted down through the diagonal into the interior bore of the body. Inserting the cords or handles through the slot in this manner also threads the cords or handles through the internal bore of the tubular body.

With the carrier attached to the cords or loop handles, the carrier may be rotated around its longitudinal axis to any orientation of the carrier relative to the cords or handles without accidentally disconnecting the carrier. This is so because the spiral slot formed in the carrier extends at least one half of a complete revolution around the circumference of the carrier as it extends from one end of the carrier to the next. There is no orientation position that the carrier may occupy relative to the cords or handles of the package or shopping bag in which the carrier may be separated from the cords or handles by simply pulling the carrier laterally from the cords or handles.

To remove the carrier from the cords or handles of the package or shopping bag, the cords or handles threaded through the internal bore of the carrier are first inserted into the slot at one end of the carrier. The carrier is then rotated relative to the cord or handles in a direction that causes the cord or handles to be directed along the spiraling slot from the end of the carrier at which the cords or handles were inserted into the slot, to the opposite end of the carrier. Directing the cords or handles to the opposite end of the slot in this manner completely disconnects the cords or handles from the carrier.

Alternatively, the carrier body is held so that the slot appears as a diagonal extending across the bottom of the body between its first and second ends. The carrier body is then turned counterclockwise so that the axis of the tubular body is at a slight angle relative to the cords extending through the internal bore of the body. Positioning the body relative to the cords in this manner positions the cords adjacent the slot so that they can be passed through the slot and disengaged from the body of the carrier.

The carrier apparatus of the invention is constructed from a resilient material, preferably plastic, that enables the spiraling slot in the carrier to be expanded if necessary. This enables the carrier apparatus to be attached on packages or shopping bags having cords or handles of varying cross section dimensions, the width of the slot expanding to enable the passage of the cords or handles along the length of the spiraling slot. The expanding slot also enables the carrier of the invention to be used in carrying more than one shopping bag or package. If so desired, the apparatus may also be constructed of a more rigid material.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
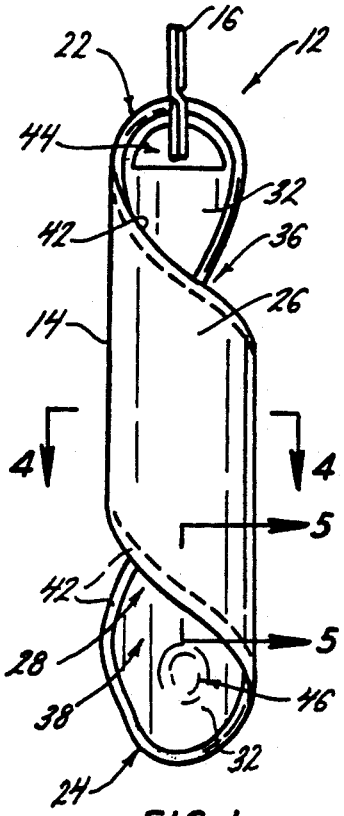
FIG. 1 is an elevation view of the carrier apparatus of the present invention.
Figure 2:
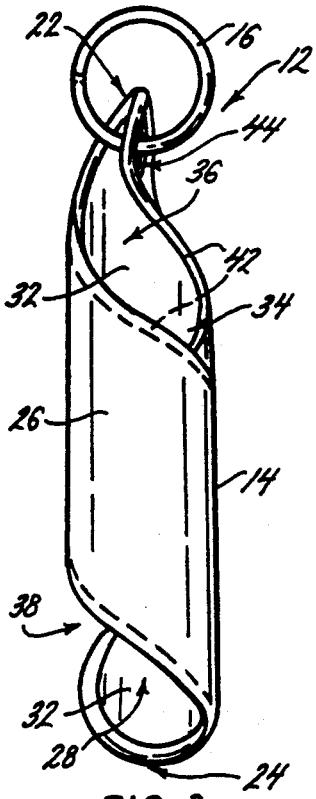
FIG. 2 is an elevation view of the apparatus of the present invention turned one quarter turn from the orientation of the invention shown in FIG. 1.
Figure 3:
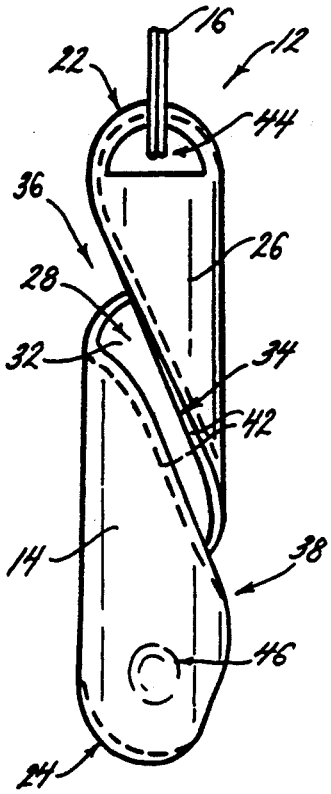
FIG. 3 is an elevation view of the present invention turned one quarter turn from the orientation of the invention shown in FIG. 2.
Figure 4:
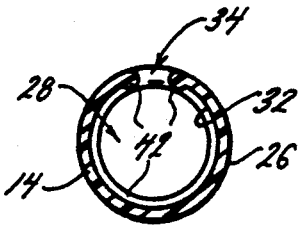
FIG. 4 is a plan view, in section, of the apparatus of the invention taken along the line 4—4 of FIG. 1.
Figure 5:
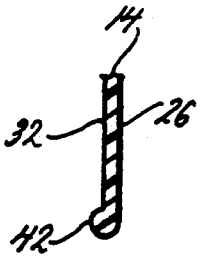
FIG. 5 is a segmented plan view, in section, of the apparatus of the invention taken along the line 5—5 of FIG. 1.

The carrier apparatus 12 of the present invention is best seen in FIGS. 1-3 of the drawing figures. The apparatus 12 is basically comprised of a carrier body 14 and a key ring 16 detachably connected to the carrier body. The carrier body 14 is constructed from a resilient material, preferably plastic, although it may also be constructed of more rigid material if so desired. The carrier apparatus 12 is inexpensive to manufacture, is lightweight, and is easily manipulated in use as will be explained.

As seen in the drawing figures, the carrier body 14 has a general tubular configuration with opposite first 22 and second 24 ends. The carrier body 14 is formed having a predetermined longitudinal length between its first and second ends 22, 24, the length of the body being chosen to comfortably lie across the palm of a hand of a user. The body has a general cylindrical exterior surface 26 and a hollow cylindrical bore 28 extending longitudinally through its interior. The internal bore 28 is surrounded by an interior cylindrical surface 32 of the carrier body 14.

A slot 34 is formed in the carrier body 14 between its first and second ends 22, 24. As seen in the drawing figures, the slot 34 is formed as a continuous spiral that spirals at least one half of a revolution around the carrier body between its first and second ends. In the preferred embodiment of the invention the slot 34 spirals one complete revolution around the body as it extends longitudinally between the body's first 22 and second 24 ends. Opposite first and second ends of the slot 36, 38 diverge and open wide at the opposite first and second ends 22, 24 of the carrier body 14, respectively. The edges of the carrier body interior surface 32 that border opposite sides of the slot 34 are rounded to form a lip 42 adjacent the opposite sides of the slot. The lip 42 projects into the internal bore 28 and presents a smooth edge on opposite sides of the slot for its entire longitudinal length. The lip 42 aids in preventing cords extending through the internal bore of the carrier from being inadvertently passed through the slot and disengaged from the carrier.

The key ring 16 is a conventional key ring and is attached to the carrier body 14 through a semicircular opening 44 at the first end 22 of the body. The key ring 16 is an optional feature of the invention and may be replaced by a key chain or other type of chain, or may be dispensed with completely without affecting the functioning of the carrier apparatus of the invention in carrying packages. A small depression 46 is formed in the exterior surface 26 of the body at the opposite end of the body from the key ring 16. The depression is provided for the thumb of the user and enhances the comfortable fit of the carrier body in the user's hand.

Figure 6:
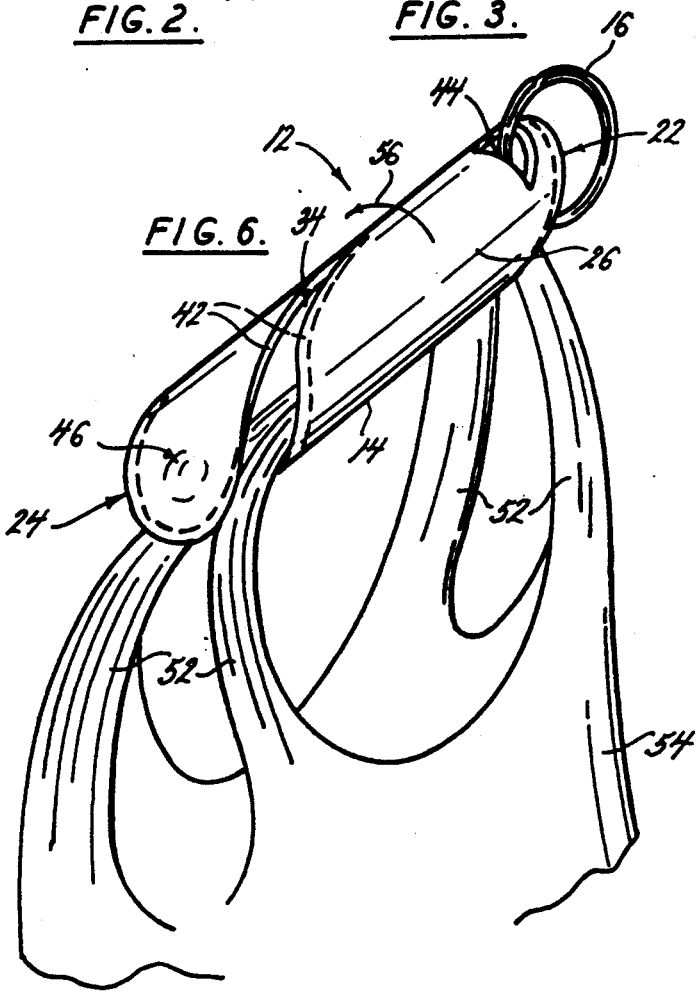
FIG. 6 is a perspective view of the invention shown in one operative environment.

FIG. 6 shows the carrier apparatus 12 of the present invention attached in its operative position on a pair of handles or cords 52 of a conventional plastic shopping bag 54. The terms "cord" or "handle" are used herein interchangeably to mean the string or cord handles formed at the tops of some paper shopping bags, the plastic handles formed at the top of some plastic shopping bags, the handles of a purse, the loop handles of a laundry bag, as well as string cords used to bind boxes and packages and any other type of cord secured to a object to be carried. In connecting the apparatus 12 of the invention on the cords or handles 52 of the shopping bag 54 shown in FIG. 6, the cords or handles 52 are first inserted into the first end 36 of the slot 34 at the first end 22 of the carrier body. The divergence of the slot at the first end 36 facilitates the insertion of the two bag handles 52 into the slot. With the handles or cords inserted in the first end of the slot, the carrier body 14 is then rotated around its longitudinal axis in a first direction indicated by the arrow 56 in drawing FIG. 6. By rotating the carrier body 14, the cords or handles 52 are directed through the spiraling slot 32 from the first end 22 of the body to the opposite second end 24 of the body where the handles exit the second end 38 of the slot. Directing the cords or handles 52 through the slot 34 in this manner threads the cords or handles through the interior bore 28 of the carrier body and attaches the carrier on the cords or handles in the orientation shown in FIG. 6.

Alternatively, the cords or handles 52 may be threaded through the internal bore 28 of the carrier body 14 by first inserting the cords or handles into the second end 38 of the slot, and then rotating the carrier body 14 around its longitudinal axis in a direction opposite to that indicated by the arrow 56. This will also cause the cords or handles to be directed along the spiraling slot and thread the cords or handles through the internal bore 28 of the carrier.

In a further alternative, the carrier body 14 is held in substantially the same orientation shown in FIG. 6, with the slot 34 appearing as a diagonal extending over the top of the carrier between its opposite ends 22, 24. In this orientation, the handles 52 of the bag are held straight over the slot and are inserted down through the slot into the carrier internal bore 28. The downward curvature of the opposite ends 36, 38 of the slot directs the bag handles 52 through the opposite ends of the slot as they fall through the intermediate portion of the slot 34 and into the carrier internal bore 28. The upward curvature of the opposite ends 22, 24 of the carrier body 14 and the lips 42 running along the opposite sides of the slot 34 prevent the bag handles 52 from falling through the slot and out of the internal bore 28 when the carrier body is turned 180 degrees from the orientation shown in FIG. 6.

As seen in FIG. 6, with the carrier body 14 attached to the cords or handles 52 of the bag 54, the carrier may be rotated in opposite directions around its longitudinal axis to any orientation of the carrier relative to the cords or handles and some portion of the carrier body 14 will extend beneath the cords or handles 52 shown in the drawing figure, preventing the carrier body 14 from being accidentally disconnected from the cords or handles. There is no orientation position that the carrier body 14 may occupy relative to the cords or handles 52 of the bag in which the carrier may be separated from the cords or handles by simply pulling the carrier laterally from the bag.

To remove the carrier apparatus 12 from the cords or handles 52 of the bag 54, the cords or handles threaded through the interior bore 28 are again inserted into the first end of the slot 36 at the first end 22 of the carrier body. The carrier is then rotated in the first direction indicated by the arrow 56 relative to the cords or handles 52. The rotation of the carrier body 14 around its longitudinal axis causes the cords or handles 52 to be directed along the length of the slot 34 from the first end 22 of the carrier body to the opposite second end 24 of the body. As the cords or handles 52 are directed out of the slot 34 at the second end 38 of the slot, the carrier body 14 is completely disconnected from the cords or handles.

Alternatively, the cords or handles 52 may be removed from the internal bore 28 of the carrier body 14 by first inserting the cords or handles into the second end 38 of the slot, and then rotating the carrier body 14 around its longitudinal axis in a direction opposite to that indicated by the arrow 56. This will also cause the cords or handles to be directed along the spiraling slot from the second end 38 of the slot to the opposite first end 36 of the slot where the cords or handles will exit the slot, thereby completely disconnecting the carrier apparatus 12 from the cords or handles of the bag.

In a still further alternative, the carrier body 14 is rotated about its axis 180° from the orientation of the body shown in FIG. 6. In this position of the body, the slot 34 appears as a diagonal extending over the bottom of the carrier between its opposite ends 22, 24. In this orientation, the handles or cords 52 extend straight through the internal bore of the carrier parallel with the carrier axis and at a slight angle to the diagonal formed by the slot 34. The user then turns the carrier slightly in a counterclockwise direction as viewed in FIG. 6, so that the handles or cords extending through the internal bore of the carrier are positioned at a slight angle to the center axis of the carrier. Positioning the carrier body relative to the cords in this manner positions the cords parallel and adjacent to the slot 34. With some slight manipulation of the carrier body the cords can be easily passed through the slot and disengaged from the body of the carrier.

As stated earlier, the carrier body 14 is preferably constructed of a resilient material that enables the slot 34 to expand as cords or handles of larger cross sectional dimensions are passed through the slot. The expandability of the slot also enables cords or handles of more than one package or shopping bag to pass through the slot, making it possible to attach the carrier apparatus 12 to the cords or handles of several packages or shopping bags to carry the several packages or bags. The tubular configuration of the carrier apparatus 12 can be formed by a variety of methods including, but not being limited to, forming the apparatus in a mold, or forming the apparatus from a strip of resilient material wound spirally around a cylindrical mandrel.

While the present invention has been described by reference to a specific embodiment, it should be understood that modifications and variations of the invention may be constructed without departing from the scope of the invention defined in the following claims. For example, the revolutions of the slot around the carrier body may be partially or wholly increased or decreased without departing from the scope of the invention defined in the following claims.

What is claimed is:

1. A carrier apparatus for carrying an object having a cord for suspending the object, the carrier apparatus comprising:

a carrier body having a given longitudinal length and opposite first and second ends, the body having an exterior surface and an interior surface, the interior surface forming an internal bore extending longitudinally through the body between the first and second ends; and a slot formed in the body between the exterior and interior surfaces and extending longitudinally along the body between the first and second ends, the slot being formed as a continuous spiral that spirals at least one half a revolution around the body as it extends longitudinally between the first and second ends; wherein the slot receives the object cord when the object is carried.

2. The carrier apparatus of claim 1, wherein:

the carrier body is constructed of a resilient material that enables the slot to expand as the object cord is passed through the slot.

3. The carrier apparatus of claim 1, wherein:

the slot is configured to receive the object cord at the first end of the body, and to thread the cord through the internal bore of the body in response to rotating the body in a first direction relative to the cord.

4. The carrier apparatus of claim 3, wherein:

the spiraling configuration of the slot directs the object cord received by the slot at the first end of the body, longitudinally along the slot to the second end of the body in response to rotating the body in the first direction one complete revolution relative to the cord.

5. The carrier apparatus of claim 4, wherein:

the slot is configured to receive the object cord threaded through the internal bore at the second end of the body, and to remove the cord from the internal bore in response to rotating the body in a second direction relative to the cord.

6. The carrier apparatus of claim 5, wherein:

the spiraling configuration of the slot directs the object cord threaded through the internal bore and received by the slot at the second end of the body, longitudinally along the slot to the first end of the body in response to rotating the body in the second direction one complete revolution relative to the cord.

7. The carrier apparatus of claim 1, wherein:

a lip is formed on the interior surface of the carrier body adjacent opposite sides of the slot, the lip projects into the internal bore of the carrier body.

8. The carrier apparatus of claim 1, wherein:

a key ring is detachably secured to one of the first and second ends of the body.

9. The carrier apparatus of claim 1, wherein:

the slot is formed as a continuous spiral that spirals at least one complete revolution around the body as it extends longitudinally between the first and second ends.

10. A carrier apparatus for carrying an object having a cord for suspending the object, the carrier apparatus comprising:

a tubular body having opposite first and second ends, a cylindrical exterior surface extending longitudinally over the body between the first and second ends, a cylindrical interior surface forming an internal bore extending longitudinally through the body between the first and second ends; and a slot formed in the body between the exterior and interior surfaces and extending longitudinally across the body between the first and second ends, the slot being formed as a continuous spiral that spirals at least one half a revolution around the tubular body as it extends longitudinally between the first and second ends; wherein the slot receives the object cord when the object is carried.

11. The apparatus of claim 10, wherein:

the slot is configured to receive the object cord at the first end of the body and thread the cord through the internal bore by directing the cord longitudinally along the slot to the second end of the body in response to rotating the body in a first direction one complete revolution relative to the cord.

12. The apparatus of claim 10, wherein:

the tubular body is constructed of a resilient material enabling the slot to expand to receive cords of varying dimensions.

13. The apparatus of claim 10, wherein:

a lip is formed on the interior surface of the tubular body adjacent opposite sides of the slot, the lip projects into the internal bore of the tubular body.

14. The apparatus of claim 11, wherein:

the slot is configured to receive the object cord threaded through the internal bore at the second end of the body, and direct the cord longitudinally along the slot to the first end of the body in response to rotating the body in a second direction one complete revolution relative to the cord, thereby removing the cord from the internal bore of the body.

15. A carrier apparatus for carrying an object having a cord by suspending the object from the cord, the carrier apparatus comprising:

a carrier body having a configuration of a thin strip of material wound spirally around a longitudinally axis into a tubular configuration;

the tubular configuration having opposite first and second ends, an exterior surface, and an interior surface surrounding an internal bore extending axially through the tubular configuration; and a slot formed between adjacent spirals of the strip of material, the slot extending across the tubular configuration between the first and second ends and spiraling continuously around the tubular configuration at least one half a revolution between the first and second ends; wherein the slot receives the object cord when the object is carried.

16. The carrier apparatus of claim 15, wherein:

the material of the strip is a resilient material, the resiliency of the material enables the slot between adjacent spirals to expand by separating the adjacent spirals.

17. The carrier apparatus of claim 15, wherein:

the slot formed between adjacent spirals is formed to receive the object cord at the first end of the tubular configuration, and to thread the cord through the internal bore of the tubular configuration in response to rotating the tubular configuration relative to the cord in a first direction about the longitudinal axis.

18. The carrier apparatus of claim 15, wherein:

a lip is formed on the interior surface of the tubular configuration adjacent opposite sides of the slot, the lip projects into the internal bore of the tubular configuration.

19. The carrier apparatus of claim 18, wherein:

the slot formed between adjacent spirals is formed to receive the object cord threaded through the internal bore of the tubular configuration at the second end of the tubular configuration, and to remove the cord from the internal bore in response to rotating the tubular configuration relative to the cord in a second direction about the longitudinal axis.

20. The carrier apparatus of claim 19, wherein:

the spiraling of the slot around the tubular configuration directs the object cord threaded through the internal bore and received by the slot at the second end of the tubular configuration,. longitudinally along the slot to the first end of the tubular configuration in response to rotating the tubular configuration relative to cord in the second direction one complete revolution.

* * * * *